US007172500B1

(12) United States Patent
Wu

(10) Patent No.: US 7,172,500 B1
(45) Date of Patent: Feb. 6, 2007

(54) KNIFE SHARPENER

(76) Inventor: Wen-Chiu Wu, No. 10, Lane 3, Sec. 2, Yuan Lu Rd., Haoxiu Village, Pu Yen Hsiang, Chang Hua Hsien (TW)

( * ) Notice: Subject to any disclaimer, the term of this patent is extended or adjusted under 35 U.S.C. 154(b) by 0 days.

(21) Appl. No.: 11/509,011

(22) Filed: Aug. 24, 2006

(51) Int. Cl.
*B24B 3/36* (2006.01)

(52) U.S. Cl. ..... 451/319; 451/486; 451/552; 76/82; 76/86; 76/88

(58) Field of Classification Search ..... 451/319, 451/486, 549, 552, 555, 557; 76/82, 86, 76/87–89
See application file for complete search history.

(56) References Cited

U.S. PATENT DOCUMENTS 4,550,632 A * 11/1985 Inman ..... 76/86
4,672,777 A * 6/1987 Dunkin ..... 451/282
5,040,435 A * 8/1991 Millman ..... 76/86
5,461,942 A * 10/1995 Kelley ..... 76/87
6,875,093 B2 * 4/2005 Friel et al. ..... 451/260
6,881,137 B2 * 4/2005 Friel, Sr. ..... 451/349
D519,815 S * 5/2006 Friel et al. ..... D8/91

* cited by examiner

*Primary Examiner*—Lee D. Wilson
*Assistant Examiner*—Anthony Ojini
(74) *Attorney, Agent, or Firm*—Hershkovitz & Associates; Abe Hershkovitz

(57) ABSTRACT

A knife sharpener has a housing, a base, a sharpening device and an adjustable device. The housing has a case, a cavity and a slot. The cavity is defined in the case and the slot is defined in the case and communicates with the cavity. The base is mounted on the housing and has a base board and two side walls formed on the base board. The sharpening device is movable mounted on the base and is received inside the housing. The sharpening device has two sharpening arms with sharpening rods. The adjustable device is mounted on the sharpening device mounted between the two sharpening arms. When the knife sharpener is used, the adjustable device is rotated to change the cross-position of the sharpening device. Therefore, a knife may be sharpened at a different site on the sharpening rods for prolonging the life span of the knife sharpener.

8 Claims, 6 Drawing Sheets

KNIFE SHARPENER

BACKGROUND OF THE INVENTION

1. Field of the Invention

The present invention relates to a knife sharpener, and more particularly to an adjustable knife sharpener that is adjustable and is convenient in use.

2. Description of Related Art

Knives are common tools in the kitchen. When a knife is dull, people often need a sharpener for sharpening the knife. There are various types of the conventional knife sharpeners, including electric knife sharpeners and steel knife sharpeners. However, the conventional knife sharpeners do not provide a function of adjusting, so knives may be sharpened at the same position on the conventional knife sharpener. Therefore, the life span of the conventional knife sharpeners is reduced caused by sharpening a knife at the same site.

To overcome the shortcomings, the present invention tends to provide a knife sharpener to mitigate the aforementioned problems.

SUMMARY OF THE INVENTION

The primary objective of the present invention is to provide a knife sharpener that is adjustable and is convenient in use.

A knife sharpener has a housing, a base, a sharpening device and an adjustable device. The housing has a case, a cavity and a slot. The cavity is defined in the case and the slot defined in the case and communicates with the cavity. The base is mounted on the housing and has a base board and two side walls formed on the base board. The sharpening device is movable mounted on the base and is received inside the housing. The sharpening device has two sharpening arms with sharpening rods. The adjustable device is mounted on the sharpening device mounted between the two sharpening arms.

When the knife sharpener is used, the adjustable device is rotated to change the cross-position of the sharpening device. Therefore, a knife may be sharpened at a different site on the sharpening rods for prolonging the life span of the knife sharpener.

Other objects, advantages and novel features of the invention will become more apparent from the following detailed description when taken in conjunction with the accompanying drawings.

DETAILED DESCRIPTION OF THE PREFERRED EMBODIMENT

Figure 1:
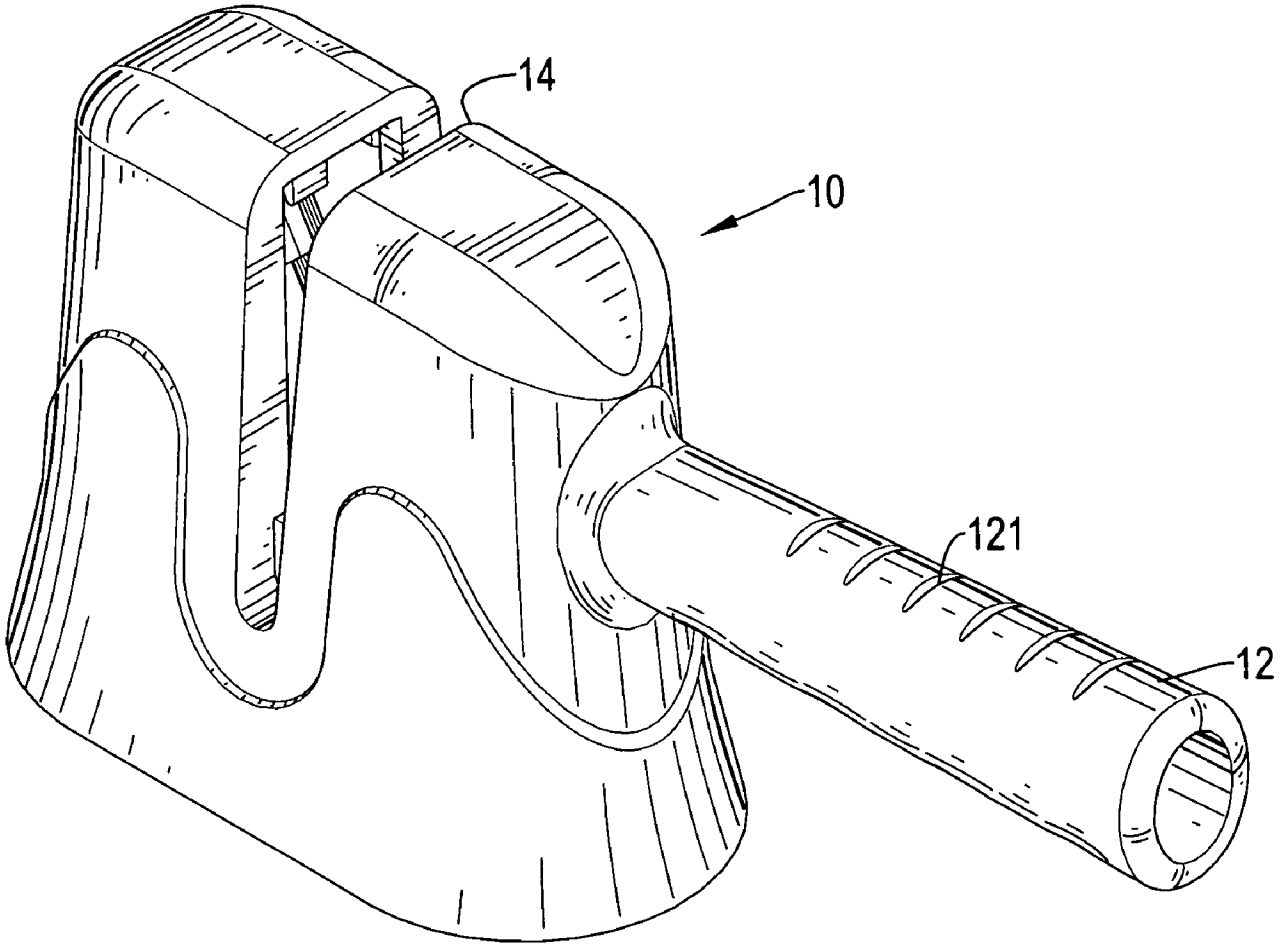
FIG. 1 is a perspective view of a knife sharpener in accordance with the present invention.
Figure 2:
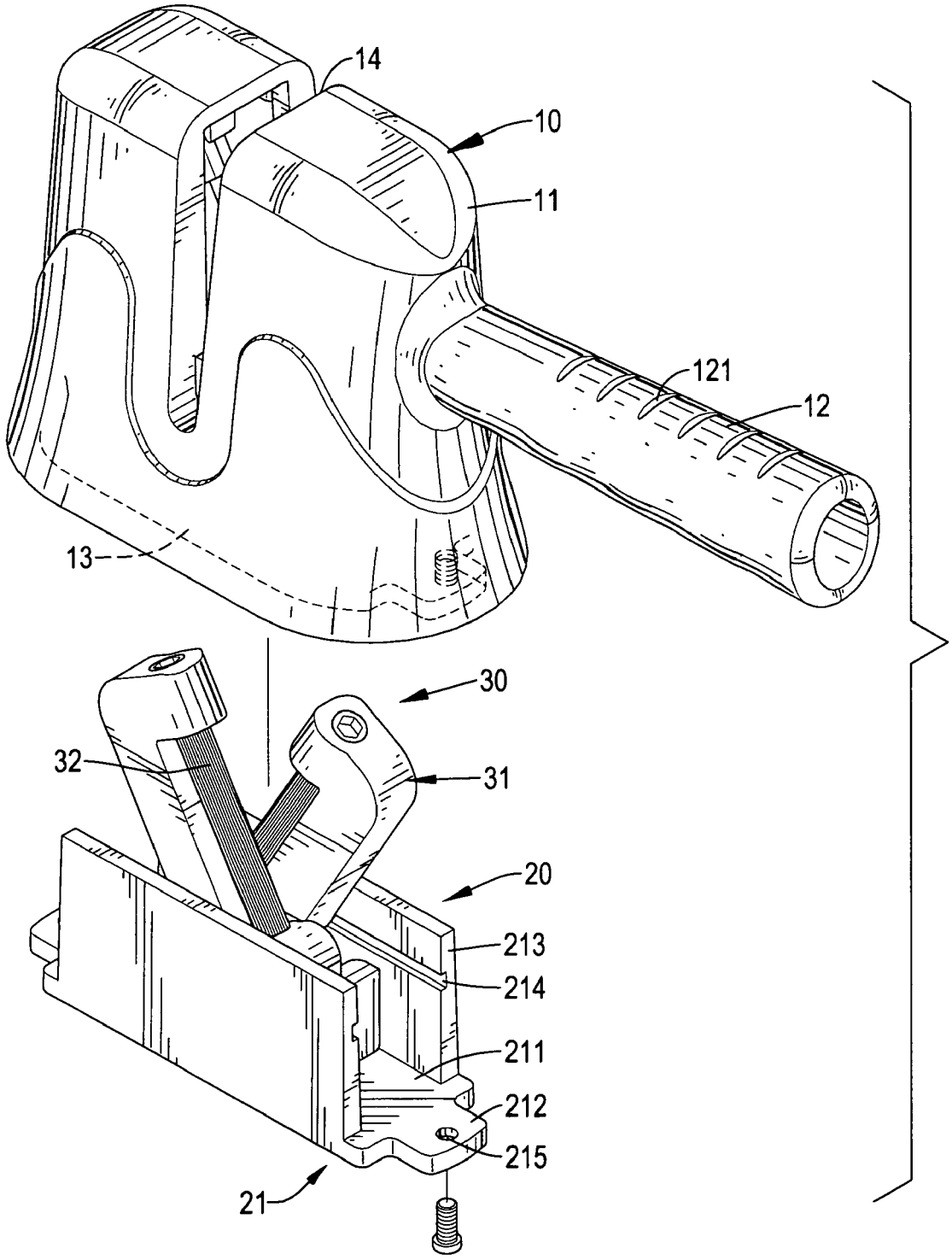
FIG. 2 is a partially exploded perspective view of the knife sharpener in FIG. 1.
Figure 3:
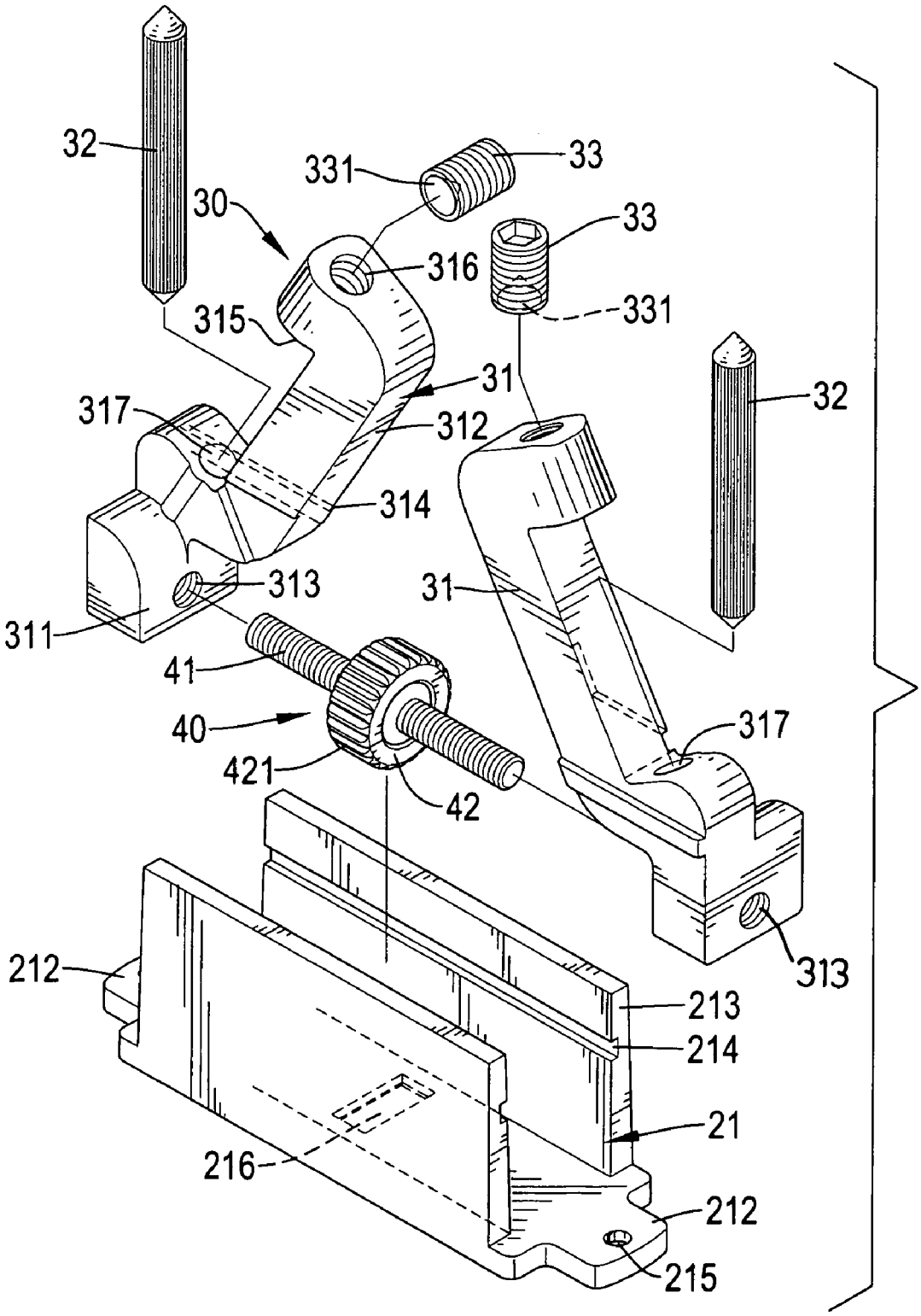
FIG. 3 is another partially exploded perspective view of the knife sharpener in FIG. 1.

To solve the shortcomings of the conventional knife sharpener, the present invention intends to provide a knife sharpener that is adjustable and is convenient in use. With reference to FIGS. 1 to 3, the knife sharpener of the present invention has a housing (10), a base (21) mounted on the housing (10), a sharpening device (30) mounted inside the housing (10) and an adjustable device (40) mounted on the sharpening device (30).

Figure 4:
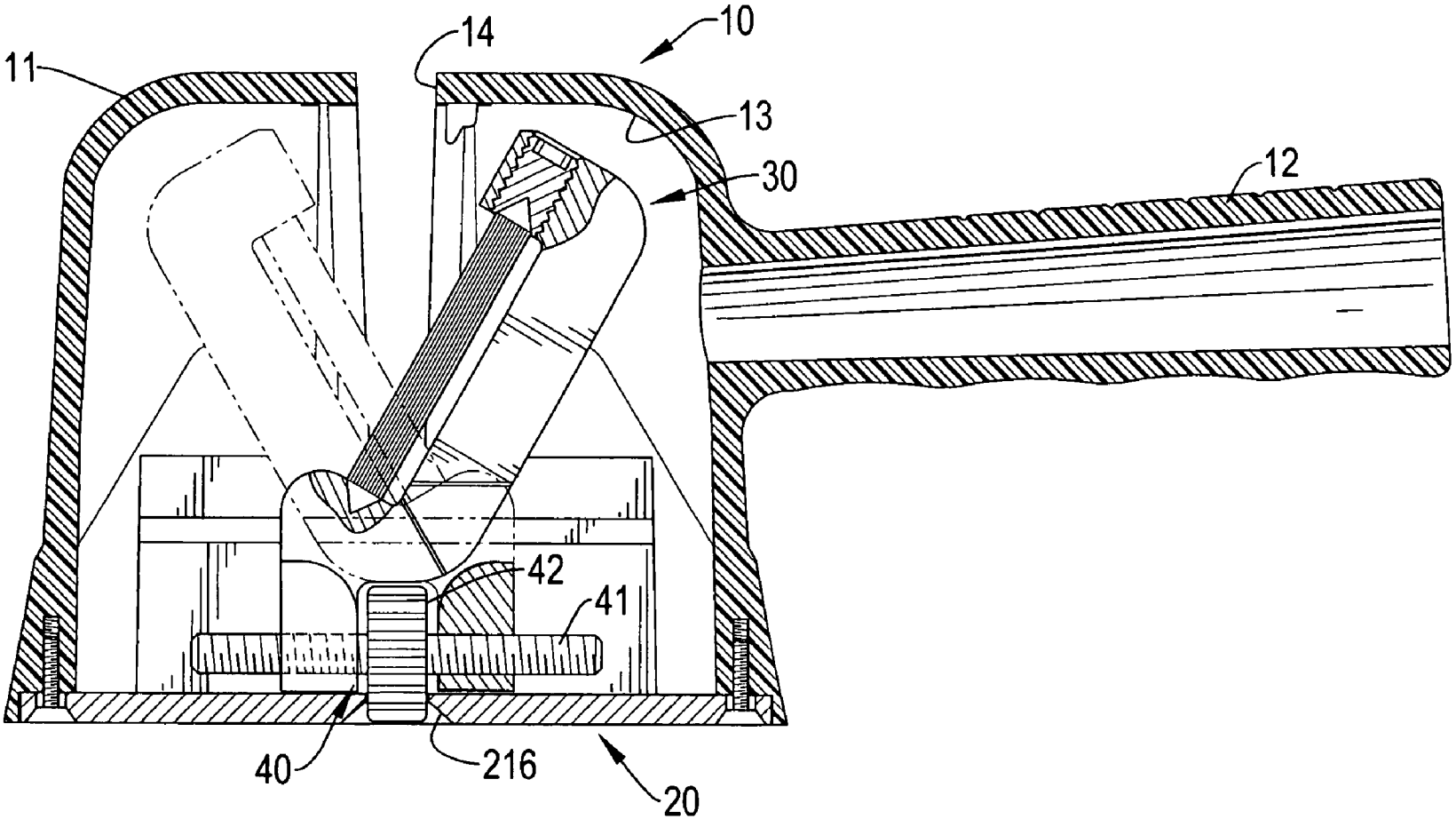
FIG. 4 is a side plan view in partial section of the knife sharpener in FIG. 1.

With further reference to FIG. 4, the housing (10) has a case (11), a handle (12), a cavity (13) and a slot (14). The case (11) has a proximal end, a top and an outer surface. The handle (12) has an outer surface and a pattern (121). The handle (12) is longitudinally formed on the proximal end of the case (11), and the pattern (121) is defined in the outer surface of the handle (12). The cavity (13) is defined in the case (11). The slot (14) is defined in the top of the case (11) and communicates with the cavity (13).

The base (21) is mounted on the case (11) and has a base board (211), two wings (212) and two side walls (213). In a preferred embodiment, the base board (211) is a rectangle board and has two ends, two side edges, a center and an operating hole (216). The two wings (212) are respectively formed on the two ends and has two through holes (215) and two bolts. The two through holes (215) are respectively defined in the wings (213). The two bolts are respectively mounted through the through holes (215) for combining the base (21) with the case (11). The two side walls (213) are respectively formed on the side edges of the base board (211). Each side wall (213) has a top, an inner surface and a transverse slot (214). The transverse slot (214) is defined in the inner surface of the side wall (213) near the top. The transverse slots (214) defined in the two side walls (213) are faced to each other. The operating hole (216) is defined through the base board (211) near the center. In a preferred embodiment, the operating hole (216) is a rectangle mounted hole.

The sharpening device (30) is movable mounted on the base (21) and received inside the housing (10). The sharpening device (30) has two sharpening arms (31), two sharpening rods (32) and two bolts (33). The two sharpening arms (31) are mounted on the base (21). Each sharpening arm (31) has a seat (311) and an arm (312). The seat (311) is held inside the base (21) and has a threaded hole (313) defined through the seat (311). The arms (312) mounted on the sharpening arms (31) are cross-mounted and the cross-position always faces to the slot (14) defined in the housing (10). The arm (312) is mounted on and inclinedly extends from the seat (311) and has an outer surface, a top end, a bottom end, a transverse rib (314), a holding recess (315), a threaded hole (316) and a receiving hole (317). The transverse rib (314) is formed on the outer surface of the arm (312) and is received inside the transverse slot (214) in the base (21) to make the arm (312) sliding relative to the base (21) along the transverse slot (214). The holding recess (315) is defined in the outer surface of the arm (312). The holding recesses (315) defined in the two arms (312) are faced to each other. The threaded hole (316) is defined in the top end of the arm (312). The receiving hole (317) is defined in the bottom end of the mounting arm (312). The sharpening rods (32) are respectively received inside the holding recesses (315) in the arms (312). Each sharpening rod (32) has two ends. One end of the sharpening rod (32) is mounted inside the receiving hole (317) in the arm (312), and the other end of the sharpening rod (32) is mounted inside the threaded hole (316) in the arm (312). The two bolts (33) are respectively screwed into the threaded holes (316) defined in the two arms (312). Each bolt (33) has a bottom and a recess (331) defined in the bottom. The recess (331) holds one end of the sharpening rod (32) inside.

The adjusting device (40) is mounted between the seats (311) of the two sharpening arms (31) of the sharpening device (30) and has a threaded rod (41) and an adjusting wheel (42). The threaded rod (41) has two ends. The two ends of the threaded rod (41) are respectively screwed through the threaded holes (313) in the seats (311) of the two sharpening arms (31). The adjusting wheel (42) is mounted on the threaded rod (41) and partially extends out the operating hole (216) in the base (21).

Figure 5:
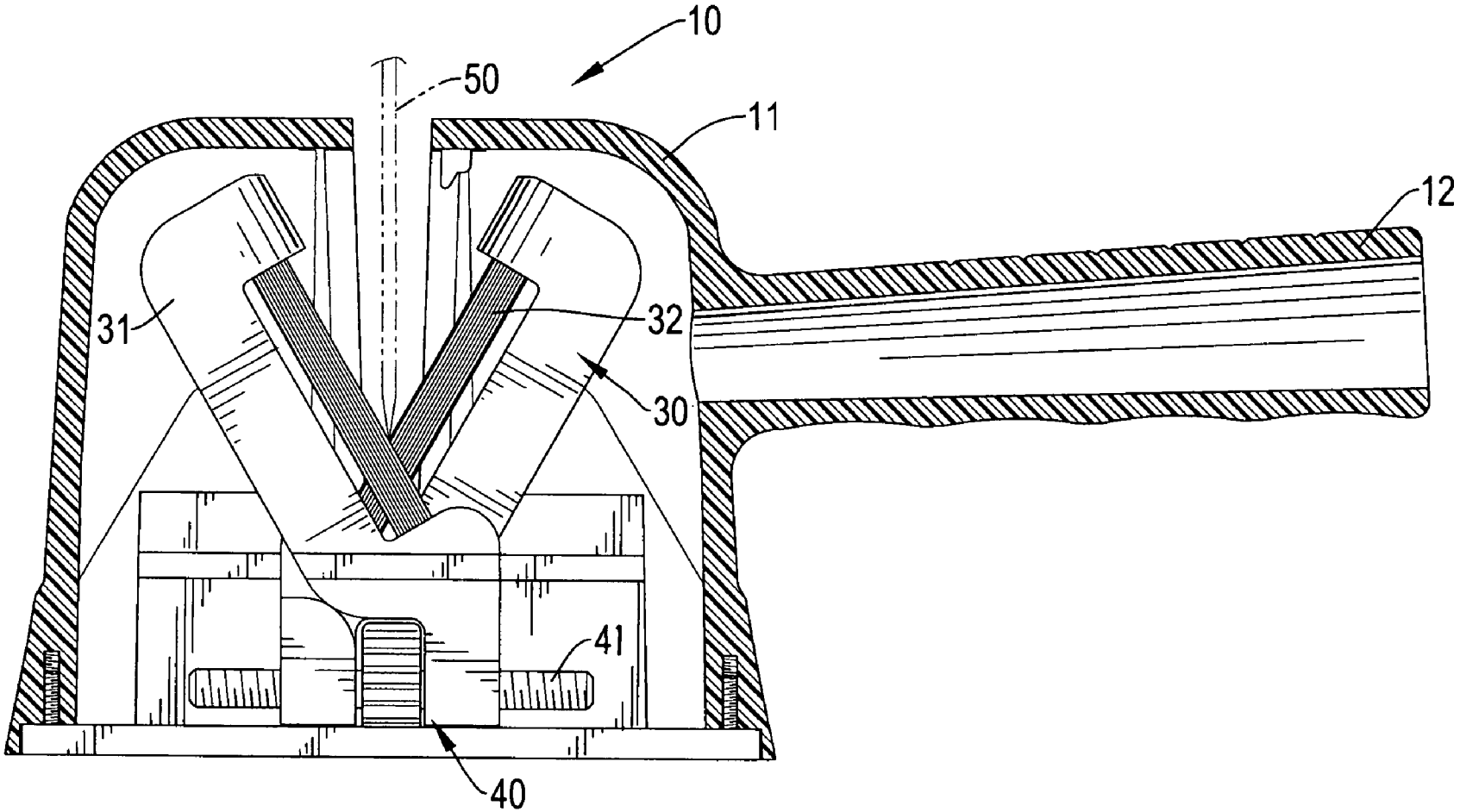
FIG. 5 is an operational side view in partial section of the knife sharpener in FIG. 1.
Figure 6:
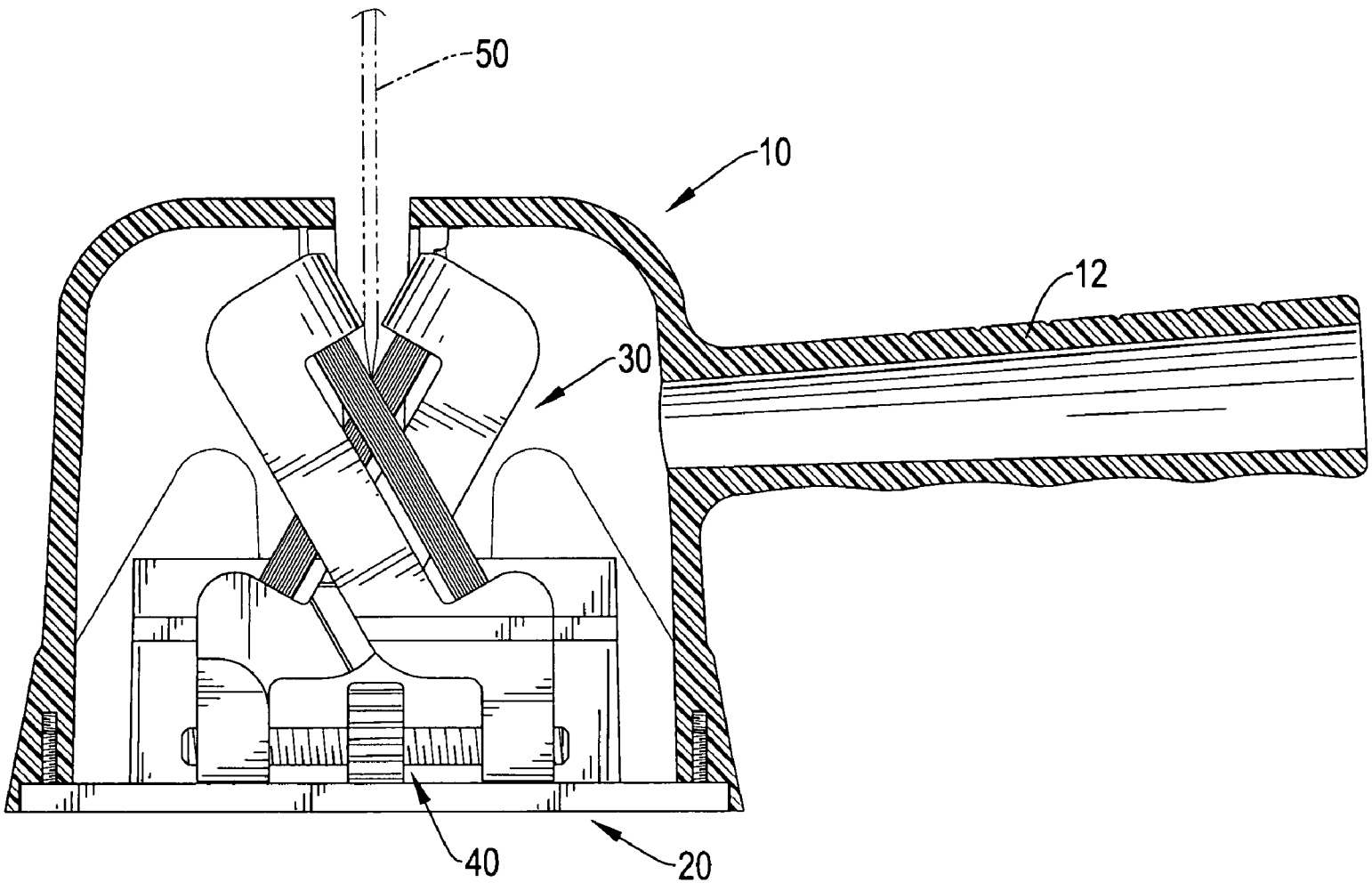
FIG. 6 is an operational side plan view in partial section of the knife sharpener in FIG. 1.

With reference to FIGS. 5 and 6, when the knife sharpener in accordance with the present invention is in use, the adjusting wheel (42) may be rotated to drive the threaded rod (41) to rotate. With the engagements between the transverse ribs (314) on the sharpening arms (31) and the transverse slots (214), the sharpening arms (31) will be moved along the threaded rod (41) when the threaded rod (41) is rotated. Therefore, positions of the sharpening arms (31) is adjusted. When a knife (50) is sharpened with the knife sharpener in accordance with the present invention, a user may optionally adjust the sharpening site of the knife sharpener for prolong the life span of the knife sharpener.

The knife sharpener in accordance with the present invention has the following advantages.

The mounting arms (31) of the knife sharpener may be adjusted simply by rotating the adjustable wheel (42), therefore, the sharpening site of the mounting arms (31) may be changed and the knife sharpener is easy to operate. Furthermore, the life span of the knife sharpener may be prolonged.

It is to be understood, however, that even though numerous characteristics and advantages of the present invention have been set forth in the foregoing description, together with details of the structure and function of the invention, the disclosure is illustrative only, and changes may be made in detail, especially in matters of raw material used, shape, size, installing surface and arrangement of parts within the principles of the invention to the full extent indicated by the broad general meaning of the terms in which the appended claims are expressed.

What is claimed is:

1. A knife sharpener comprising:

a housing having a case having a proximal end, a top and an outer surface, a cavity defined in the case, and a slot defined in the top of the case and communicating with the cavity a base mounted on the housing and having a base board being rectangle and having two ends, two side edges, two side walls respectively formed on the side edges of the base board, each side wall having an inner surface, a center, and an operating hole defined through the base board near the center, a sharpening device movable mounted on the base, received inside the housing and having two sharpening arms mounted on the base, each sharpening arm having a seat received inside the base and having a threaded hole defined through the seat, and an arm mounted on and inclinedly extending from the seat and having an outer surface, a top end, a bottom end, and a holding recess defined in the outer surface of the arm, and two sharpening rods respectively received inside the holding recesses in the arms, an adjusting device mounted on the sharpening device between the two arms of the sharpening device and having a threaded rod having two ends, the two ends of the threaded rod respectively mounted through the seats of the sharpening device, and an adjusting wheel mounted on the threaded rod and partially extending out the operating hole in the base.

2. The knife sharpener as claimed in claim 1, wherein the base further comprises two wings respectively formed on the two ends of the base board and having two through holes respectively defined in the wings, and two bolts respectively mounted through the through holes to combine the base with the case.

3. The knife sharpener as claimed in claim 2, wherein each side wall of the base further comprises a transverse slot defined in the inner surface of the side wall near the top, wherein the transverse slots defined in the side walls are faced to each other, and the arm of each sharpening arm of the sharpening device further comprises a transverse rib formed on the outer surface of the arm and received inside one of the transverse slots in the base.

4. The knife sharpener as claimed in claim 3, wherein the arm of each sharpening arm of the sharpening device further comprises a threaded hole defined in the top end of the arm, and a receiving hole defined in the bottom end of the arm for holding one end of a corresponding sharpening rod, and the sharpening device further comprises two bolts respectively screwed into the threaded holes defined in the two arms, each bolt having a bottom and a recess defined in the bottom for holding one end of the sharpening rod.

5. The knife sharpener as claimed in claim 4, wherein the housing further comprises a handle longitudinally formed on the proximal end of the case and having an outer surface and a pattern formed on the outer surface of the handle.

6. The knife sharpener as claimed in claim 1, wherein each side wall of the base further comprises a transverse slot defined in the inner surface of the side wall near the top, wherein the transverse slots defined in the side walls are faced to each other, and the arm of each sharpening arm of the sharpening device further comprises a transverse rib formed on the outer surface of the arm and received inside one of the transverse slots.

7. The knife sharpener as claimed in claim 1, wherein the arm of each sharpening arm of the sharpening device further comprises a threaded hole defined in the top end of the arm, and a receiving hole defined in the bottom end of the arm for holding one end of a corresponding sharpening rod, and the sharpening device further comprises two bolts respectively screwed into the threaded holes defined in the two arms, each bolt having a bottom and a recess defined in the bottom for holding one end of the sharpening rod.

8. The knife sharpener as claimed in claim 1, wherein the housing further comprises a handle longitudinally formed on the proximal end of the case and having an outer surface and a pattern formed on the outer surface of the handle.

* * * * *